US006048078A

United States Patent [19]

Wang

[11] Patent Number: 6,048,078

[45] Date of Patent: Apr. 11, 2000

[54] COMBINED TABLE LAMP AND CLOCK ASSEMBLY

[76] Inventor: I-Hwa Wang, No. 16, Kuo-Tai Lane, Sec. 2, Chang-Ping Rd., Pei-Tun Dist., Taichung City, Taiwan

[21] Appl. No.: 09/257,103

[22] Filed: Feb. 24, 1999

[51] Int. Cl.[7] ..... F21V 33/00

[52] U.S. Cl. ..... 362/253; 362/410; 362/414; 968/404; 968/398; 968/408; 968/410

[58] Field of Search ..... 362/253, 410, 362/414; 968/404, 398, 408, 410

[56] References Cited

U.S. PATENT DOCUMENTS 3,034,281 5/1962 Guidone ..... 968/404
4,285,028 8/1981 Sundin et al. ..... 362/253

*Primary Examiner*—Sandra O'Shea
*Assistant Examiner*—Ronald E. DelGizzi
*Attorney, Agent, or Firm*—Ladas & Parry

[57] ABSTRACT

A combined table lamp and clock assembly includes a lamp unit and a clock unit. The lamp unit includes a lamp stand base, a lamp stand, and a lamp bulb holder. The lamp stand base has a top side formed with a cavity, and a bottom side adapted to be placed on a table top. The lamp stand extends uprightly from the lamp stand base, and has an upper end portion and a lower end portion that is mounted on the top side of the lamp stand base. The lamp bulb holder is mounted on the upper end portion of the lamp stand, and is adapted for mounting a lamp bulb thereon. The clock unit includes a clock base, an upright clock panel, and a clock mechanism. The clock base is received in the cavity in the top side of the lamp stand base, and is formed with an insert slot therethrough. The upright clock panel has a lower end formed with an insert portion that is inserted removably into the insert slot. The clock mechanism is mounted on the clock panel.

5 Claims, 3 Drawing Sheets

COMBINED TABLE LAMP AND CLOCK ASSEMBLY

BACKGROUND OF THE INVENTION

1. Field of the Invention

The invention relates to a combined table lamp and clock assembly that is inexpensive to manufacture.

2. Description of the Related Art

There are various types of table lamps available in the market. Some have colorful or cute designs to enhance their appearance or appeal to children. However, although there are different types of table lamps, they fail to meet consumers' demand for variety since their appearance is often fixed and unchangeable. Besides, table lamps in general are not provided with a clock or timepiece. Although there is also available in the market a kind of table lamp with a digital clock, it is not recommended for children as they need to learn to tell time by looking at the hands of a clock.

SUMMARY OF THE INVENTION

Therefore, the main object of the present invention is to provide a combined table lamp and clock assembly which has an appealing appearance and which can encourage children to learn to tell time by looking at the hands of the clock assembly.

Accordingly, the combined table lamp and clock assembly of the present invention includes a lamp unit and a clock unit. The lamp unit includes a lamp stand base, a lamp stand, and a lamp bulb holder. The lamp stand base has a top side formed with a cavity, and a bottom side adapted to be placed on a table top. The lamp stand extends uprightly from the lamp stand base, and has an upper end portion and a lower end portion that is mounted on the top side of the lamp stand base. The lamp bulb holder is mounted on the upper end portion of the lamp stand, and is adapted for mounting a lamp bulb thereon. The clock unit includes a clock base, an upright clock panel, and a clock mechanism. The clock base is received in the cavity in the top side of the lamp stand base, and is formed with an insert slot therethrough. The upright clock panel has a lower end formed with an insert portion that is inserted removably into the insert slot. The clock mechanism is mounted on the clock panel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
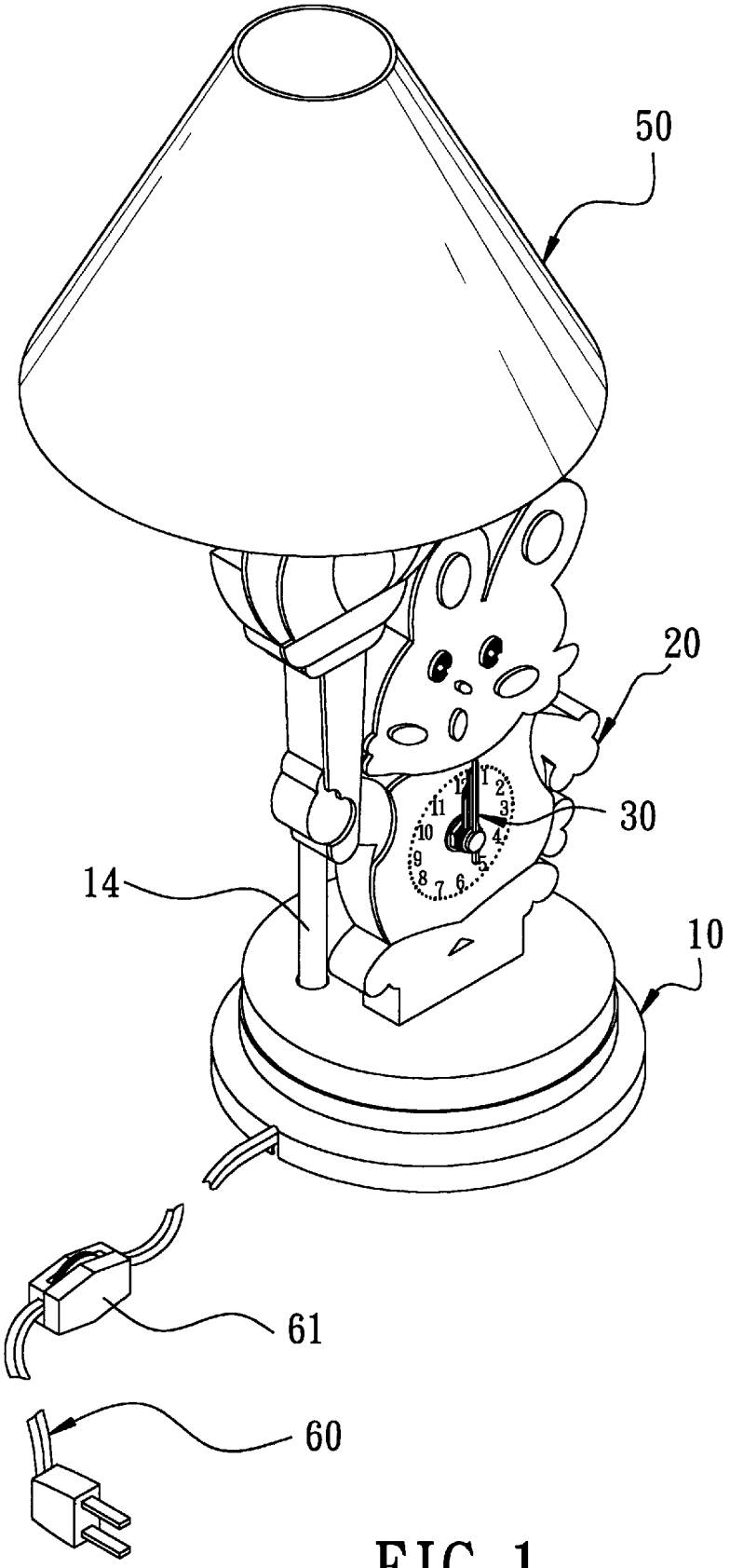
FIG. 1 is an assembled perspective view of a preferred embodiment of a combined table lamp and clock assembly according to the present invention.
Figure 2:
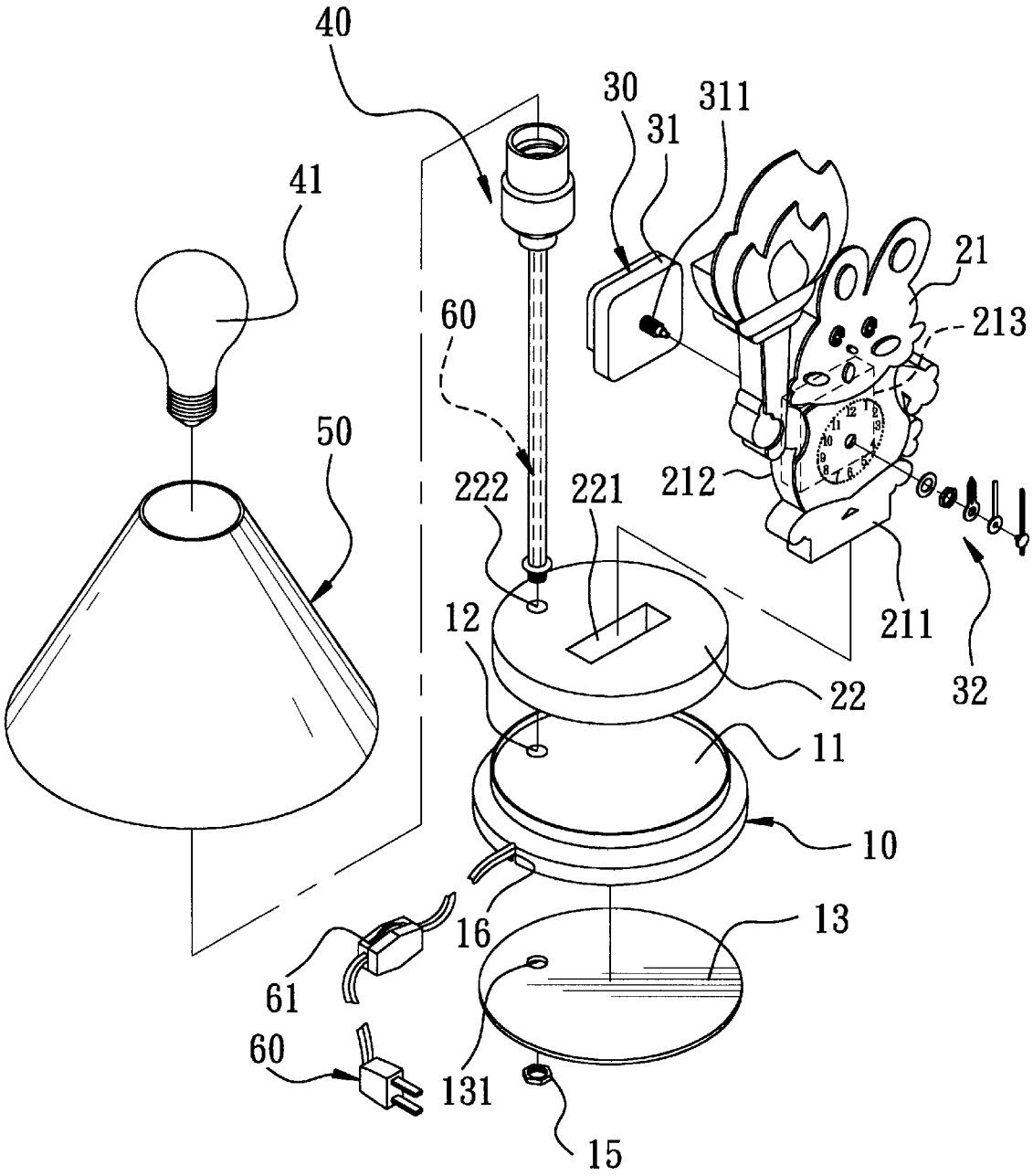
FIG. 2 is an exploded perspective view of the preferred embodiment.

Referring to FIGS. 1 and 2, the preferred embodiment of the combined table lamp and clock assembly of the present invention is shown to include a lamp stand base 10, a lamp stand 14, a clock unit 20, a clock mechanism 30, a lamp bulb holder 40, a lampshade 50, and an electrical wire 60.

The lamp stand base 10 has a top side formed with a cavity 11, and a bottom side adapted to be placed on a table top. The top side is formed with a through hole 12. The bottom side is formed with a wire slot 16 for passage of the electrical wire 60 therethrough. A metal plate 13 is disposed beneath the bottom side of the lamp stand base 10, and is formed with a through hole 131.

The stand 14 extends uprightly from the lamp stand base 10, and has an upper end portion and a lower end portion that is mounted on the top side of the lamp stand base 20.

The lamp bulb holder 40 is mounted on the upper end portion of the lamp stand 14, and is adapted for mounting a lamp bulb 41 thereon.

The electrical wire 60 has a first end connected electrically to the lamp bulb holder 40, and an opposite second end connected electrically to an electrical plug that is adapted for electrical connection with an electrical outlet (not shown). Preferably, the electrical wire 60 further has an electrical on/off switch 61 that is adapted to control on and off operation of the lamp bulb 41.

Figure 3:
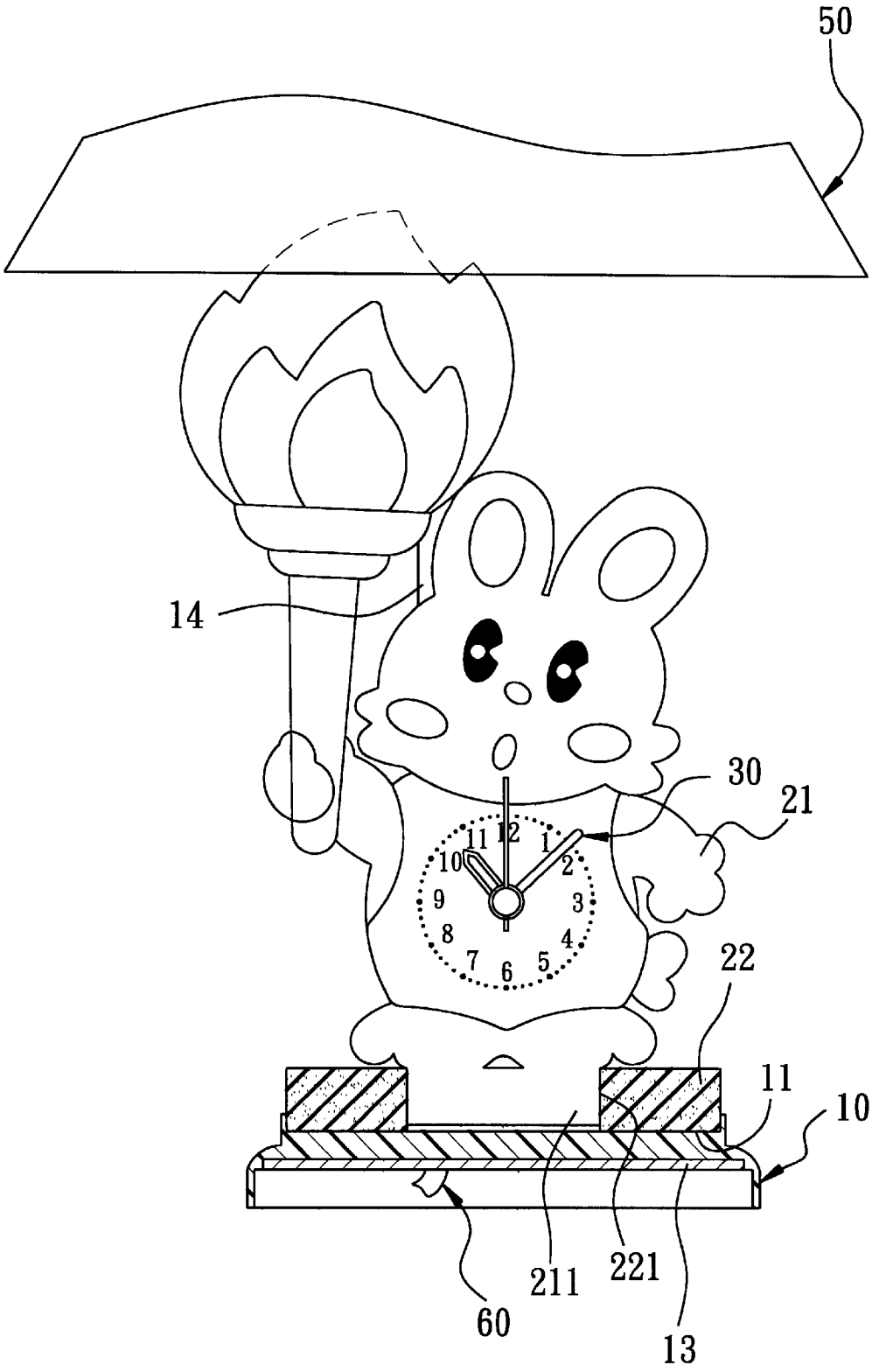
FIG. 3 is an assembled partly sectional view of the preferred embodiment.

Referring to FIG. 3, the clock unit 20 is preferably formed from a flame retardant foam material, such as ethyl vinyl acetate (EVA), and includes an upright clock panel 21 and a clock base 22. In the present embodiment, the clock panel 21 has an appearance in the form of a rabbit holding a torch. Certainly, the clock panel 21 may have an appearance other than the form of a rabbit, for instance, other animal forms, foods, or plants. The clock base 22 is received in the cavity 11 in the top side of the lamp stand base 10, and is formed with an insert slot 221 therethrough. The clock base 22 further has a through hole 222. The clock panel 21 has a lower end formed with an insert portion 211 that is inserted removably into the insert slot 221 of the clock base 22. The clock panel 21 further has a front side that serves as a clock face, and a rear side 212 formed with a clock mounting recess 213.

The clock mechanism 30 is mounted in the clock mounting recess 213 on the rear side 212 of the clock panel 21, and includes a hand driving device 31 and a clock hand set 32. The hand driving device 31 is mounted on the rear side 212 of the clock panel 21, and has a clock hand driver 311 that extends from the rear side 212 through the front side of the clock panel 21. The clock hand set 32 is mounted on the clock hand driver 311, and is disposed adjacent to the front side of the clock panel 21. The clock hand set 32 is driven by the clock hand driver 311 in a conventional manner so as to cooperate with the clock face to indicate time.

During assembly, referring once again to FIGS. 1 and 2, the clock base 22 is placed in the cavity 11 of the lamp stand base 10, with the through hole 222 of the clock base 22 aligned with the through hole 12 of the lamp stand base 10. The metal plate 13 is disposed beneath the bottom side of the lamp stand base 10, and the lower end of the stand 14 is inserted into the aligned through holes 222, 12, 131 of the clock base 22, the lamp stand base 10, and the metal plate 13, respectively. A nut 15 is then used to secure the lower end of the stand 14 on the lamp stand base 10. Subsequently, the lamp bulb holder 40 is mounted on the upper end portion of the lamp stand 14. The electrical wire 60 extends into the lamp stand 14 and out through the wire slot 16 of the lamp base stand 10. Finally, the insert portion 211 of the clock panel 21, which has the clock mechanism 30 mounted thereon, is inserted into the insert slot 221 of the lamp base 22, and the lampshade 50 is placed on top of the lamp bulb holder 40. With the lamp bulb 41 fitted in the lamp bulb holder 40, assembly of the combined table lamp and clock assembly is completed.

In the present invention, the lamp base stand 10, the clock unit 20, and the clock mechanism 30 can be assembled conveniently and quickly. The insert portion 211 of the clock panel 21 is simply inserted into the insert slot 221 of the clock base 22, and the clock base 22 is placed in the cavity 11 of the lamp stand base 10, with the lamp stand 14 at the back of the clock panel 21, whereby the clock panel 21 can stand firmly on the clock base 22 without the use of adhesives.

The design and appearance of the combined table lamp and clock assembly of the present invention is cute and can appeal to children. Moreover, the provision of the clock hand set 32 can encourage children to learn to tell the time by looking at the hands of the clock mechanism 30.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combined table lamp and clock assembly, comprising:

a lamp unit including a lamp stand base having a top side formed with a cavity, and a bottom side adapted to be placed on a table top, a lamp stand extending uprightly from said lamp stand base and having an upper end portion and a lower end portion mounted on said top side of said lamp stand base, and a lamp bulb holder mounted on said upper end portion of said lamp stand and adapted for mounting a lamp bulb thereon; and a clock unit including a clock base received in said cavity in said top side of said lamp stand base and formed with an insert slot therethrough, an upright clock panel having a lower end formed with an insert portion that is inserted removably into said insert slot, and a clock mechanism mounted on said clock panel.

2. The combined table lamp and clock assembly as claimed in claim 1, wherein said clock base is formed with a through hole for passage of said lower end portion of said lamp stand therethrough.

3. The combined table lamp and clock assembly as claimed in claim 1, wherein at least one of said clock base and said clock panel is formed from a foam material.

4. The combined table lamp and clock assembly as claimed in claim 3, wherein the foam material is ethylene vinyl acetate foam.

5. The combined table lamp and clock assembly as claimed in claim 1, wherein said clock panel has a front side that serves as a clock face, and a rear side, said clock mechanism including a hand driving device mounted on said rear side of clock panel and having a clock hand driver that extends from said rear side through said front side of said clock panel, and a clock hand set mounted on said clock hand driver and disposed adjacent to said front side of said clock panel, said clock hand set being driven by said clock hand driver so as to cooperate with said clock face to indicate time.

* * * * *